US007549265B2

(12) United States Patent
Grabowski et al.

(10) Patent No.: US 7,549,265 B2
(45) Date of Patent: Jun. 23, 2009

(54) DEVICE FOR INTRODUCING GOODS TO BE PACKED INTO PACKAGING CONTAINERS, ESPECIALLY FOLDING BOXES

(75) Inventors: Ruediger Grabowski, Waiblingen (DE); Mario Schulz, Rosengarten (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/722,543

(22) PCT Filed: Jan. 18, 2006

(86) PCT No.: PCT/EP2006/050282

§ 371 (c)(1),
(2), (4) Date: Jun. 22, 2007

(87) PCT Pub. No.: WO2006/094852

PCT Pub. Date: Sep. 14, 2006

(65) Prior Publication Data

US 2008/0184670 A1 Aug. 7, 2008

(30) Foreign Application Priority Data

Mar. 10, 2005 (DE) ..... 10 2005 011 102

(51) Int. Cl.
*B65B 5/08* (2006.01)

(52) U.S. Cl. ..... 53/251; 53/252

(58) Field of Classification Search ..... 53/250, 53/251, 252, 258

See application file for complete search history.

(56) References Cited

U.S. PATENT DOCUMENTS

| | | | | |
|---|---|---|---|---|
| 3,269,091 | A * | 8/1966 | Martin | 53/252 |
| 5,081,816 | A * | 1/1992 | Cardinali | 53/252 |
| 5,323,587 | A * | 6/1994 | Amaranti | 53/258 |
| 5,454,206 | A | 10/1995 | Bailer et al. | |
| 5,660,022 | A | 8/1997 | Lade et al. | |
| 6,339,910 | B1 | 1/2002 | Hahnel et al. | |
| 6,637,174 | B1 | 10/2003 | Dietrich et al. | |

FOREIGN PATENT DOCUMENTS

| | | |
|---|---|---|
| DE | 43 06 170 C1 | 2/1994 |
| DE | 198 48 452 A1 | 4/2000 |
| DE | 199 02 453 A1 | 7/2000 |

* cited by examiner

*Primary Examiner*—Louis K Huynh
(74) *Attorney, Agent, or Firm*—Ronald E. Greigg

(57) ABSTRACT

A device (10) for introducing goods to be packed (1, 3) into a packaging container (5) comprises transport devices (11, 15) for the packaging container (5) and the goods to be packed (1, 3). The goods to be packed (1, 3) are compressed by means of pressure elements (25), in order to be introduced into the packaging container (5). The pressure element (25) is guided on a carrier element (32) in a displaceable manner, in order to avoid damage caused by the occurrence of an excess load. Due to the mobility on the carrier element (32), only very small masses are displaced in the event of an excess load, such that the excess load protection device reacts in a reliable manner, and the device (10) has a relatively simple construction.

9 Claims, 3 Drawing Sheets

DEVICE FOR INTRODUCING GOODS TO BE PACKED INTO PACKAGING CONTAINERS, ESPECIALLY FOLDING BOXES

CROSS-REFERENCE TO RELATED APPLICATION

This application is a 35 USC 371 application of PCT/EP 2006/050282 filed on Jan. 18, 2006.

BACKGROUND OF THE INVENTION

1. Field of the Invention

The invention relates to a device for introducing goods to be packed into packaging containers, in particular folding boxes.

2. Description of the Prior Art

One device of the type with which this invention is concerned is known from German Patent DE 43 06 170 C1. In the known device, a certain number of blister strips and a package insert, wrapped and folded in C-like fashion around the blister strips, are inserted into each folding box. The closure tabs of the folding box are bent away from the folding box on the side from which the goods to be packed are inserted in order to make the full opening cross section of the folding box available. To prevent the goods to be packed from colliding with the folding box as they are being inserted a holding-down tongue is provided, which presses the stack of goods to be packed downward upon insertion. If a collision of the holding-down tongue with the folding box or the device should occur, for instance because too many blister strips are stacked one above the other, then the holding-down tongue can deviate from its normal path of motion in order to avoid damage. For this purpose, it is provided that the holding-down tongue secured to an overload carriage is deflected, together with the overload carriage, out of its original path of motion in the event of a collision or an overload. A disadvantage of this is that the adjustability is relatively complicated and that, because in the event of an overload not only the holding-down tongue but the overload carriage as well must be deflected, relatively large masses have to be moved.

SUMMARY AND ADVANTAGES OF THE INVENTION

The device according to the invention for introducing goods to be packed into packaging containers, especially folding boxes has the advantage over the prior art of being mechanically relatively simple in construction, and if the overload function responds, only relatively slight masses have to be moved, so that a secure response of the overload protector is assured.

Advantageous refinements of the device of the invention for introducing goods to be packed into packaging containers are disclosed.

BRIEF DESCRIPTION OF THE DRAWINGS

One exemplary embodiment of the invention is described in further detail below, with reference to the drawings, in which.

DESCRIPTION OF THE PREFERRED EMBODIMENT

Figure 1:
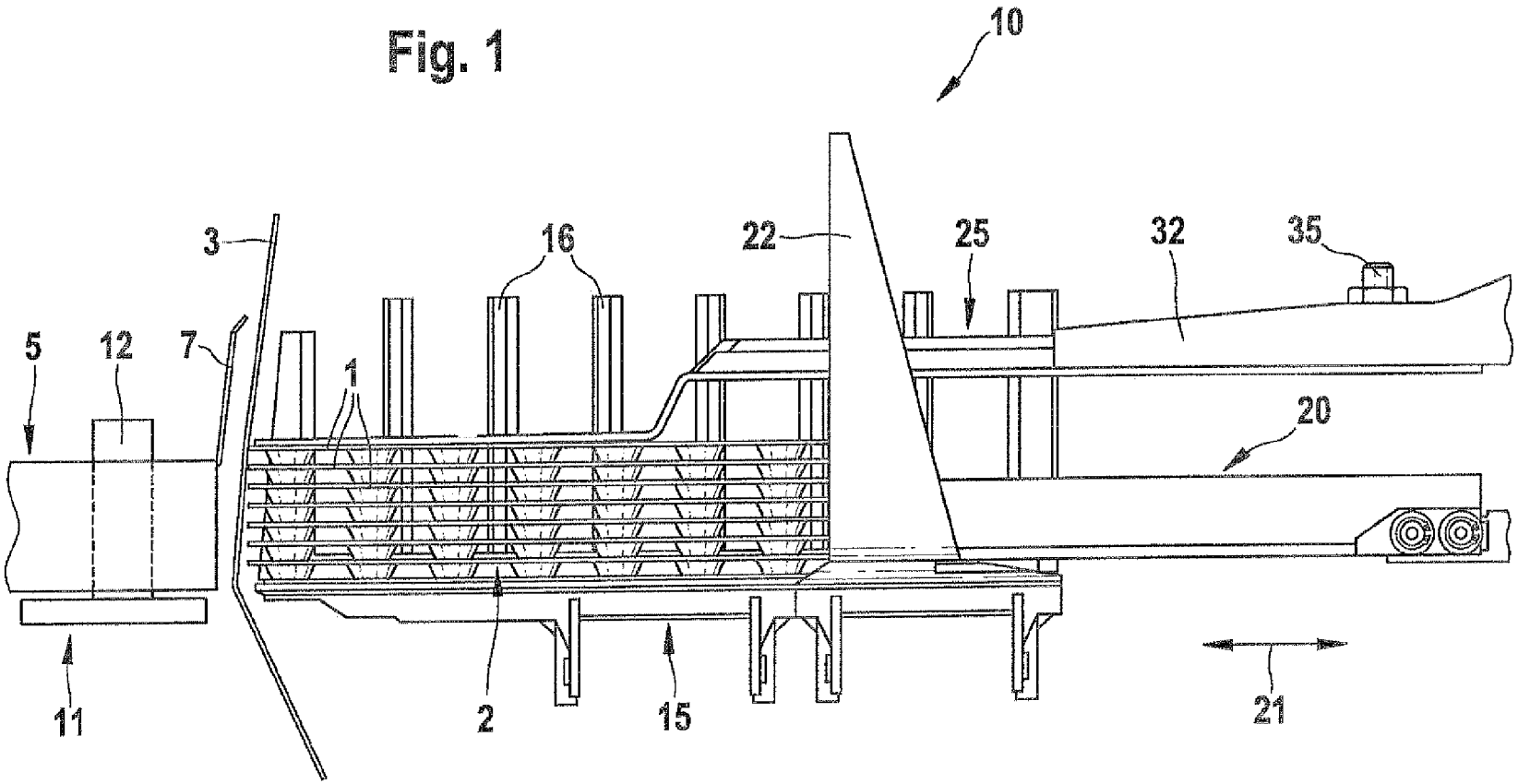
FIG. 1 shows part of a device for introducing goods to be packed into folding boxes in a side view.

The device 10, shown only in part in FIG. 1, serves to insert goods to be packed, in the form of a blister stack 2, comprising a plurality of blister strips 1, and a package insert 3, into packaging containers in the form of folding boxes 5. The folding boxes 5 are conveyed continuously or in increments by means of a first conveyor device 11 between equally spaced-apart drivers 12. A second conveyor device 15 is also provided, which conveys one blister stack 2 and one package insert 3 each between drivers 16 that form receptacles. The pitch spacing of the drivers 12 and 16 of the two conveyor devices 11 and 15 in the feeding direction extending perpendicular to the plane of the drawing is equivalent, and the motion and alignment of the drivers 12 and 16 are such that the blister stack 2 is aligned with the opening cross sections of the folding boxes 5 in the region of the device 10.

It can also be seen that the closure tabs 7 of the folding box 5, on the side toward the blister stack 2, are bent at an angle, by means of holder devices not shown, in such a way that the full opening cross section of the folding box 5 is available for inserting the blister stack 2. For the sake of simplicity, only the upper closure tab 7 of the folding box 5 for that purpose is shown. The package insert 3 is also pre-folded as an elongated strip and is placed between the folding box 5 and the blister stack 2. The package insert 3 is wrapped in the shape of a C around the blister stack 2 upon insertion of the blister stack 2 into the folding box and is positioned relative to the blister stack 2, in the position shown in FIG. 1, by means of a holder device, not shown.

The insertion of the goods to be packed is done by means of an insertion prong 20, which is movable at least in the direction of the double arrow 21. The insertion prong 20, with its insertion plate 22, acts on the blister stack 2 and pushes it together with the package insert 3 into the folding box 5.

It must also be assured that upon insertion into the folding box 5, the goods to be packed will not collide with the folding box 5. This purpose is served by a holding-down tongue 25, which acts upon or loads the blister stack 2 from above with a certain force, so that the blister stack 2 (including the package insert 3) does not exceed the height of the opening cross section of the folding box 5.

In FIG. 1, a state is shown in which too many blister strips 1 have been stacked one above the other, so that upon insertion of the blister stack 2, both the uppermost blister strip 1 and the holding-do tongue 25 would collide with the upper closure tab 7 of the folding box 5. To avoid damage to the device 10 in a collision and to trip a machine stoppage, the holding-down tongue 25 is equipped with an overload protector.

Figure 2:
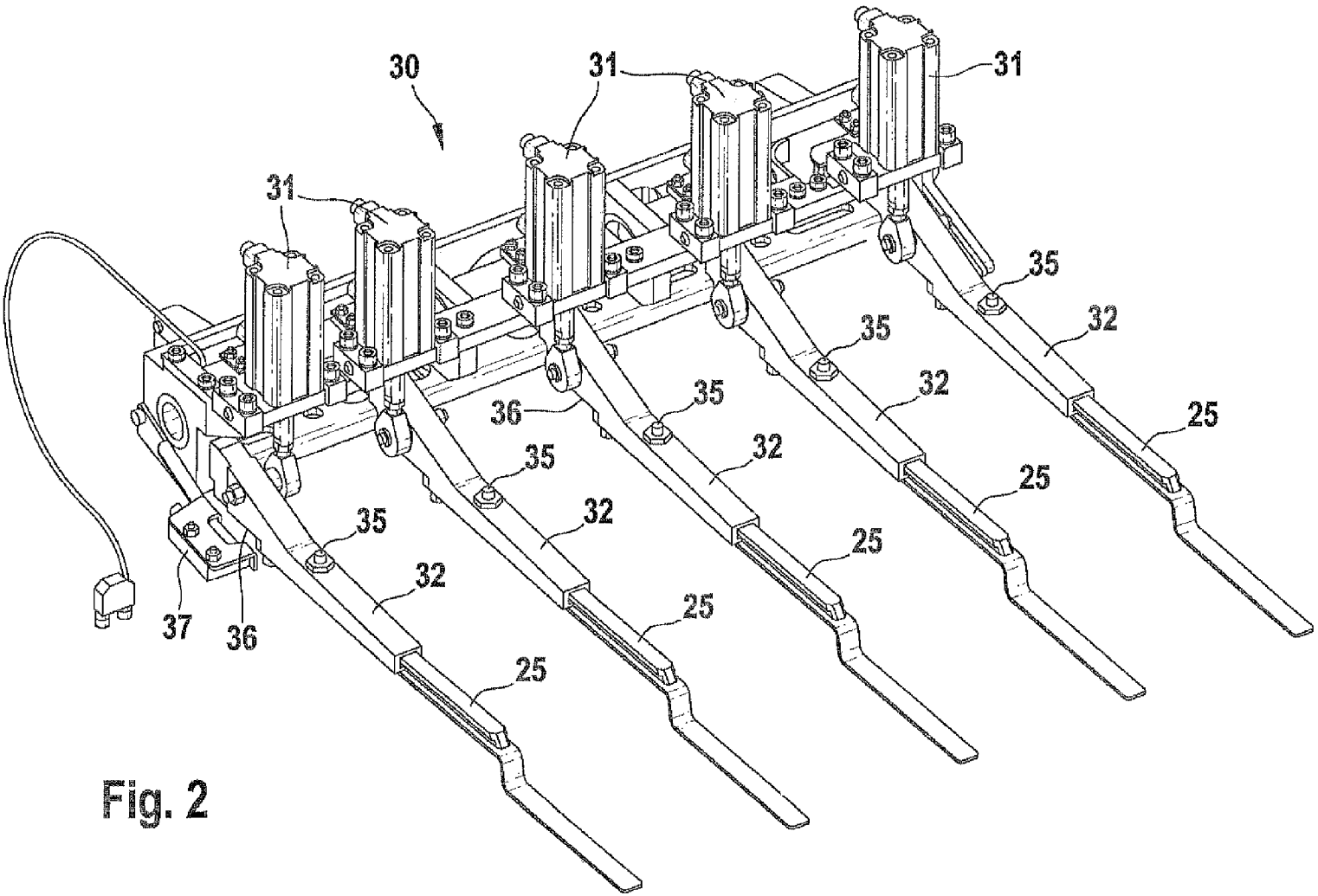
FIG. 2 shows a holding-down component group in perspective.
Figure 3:
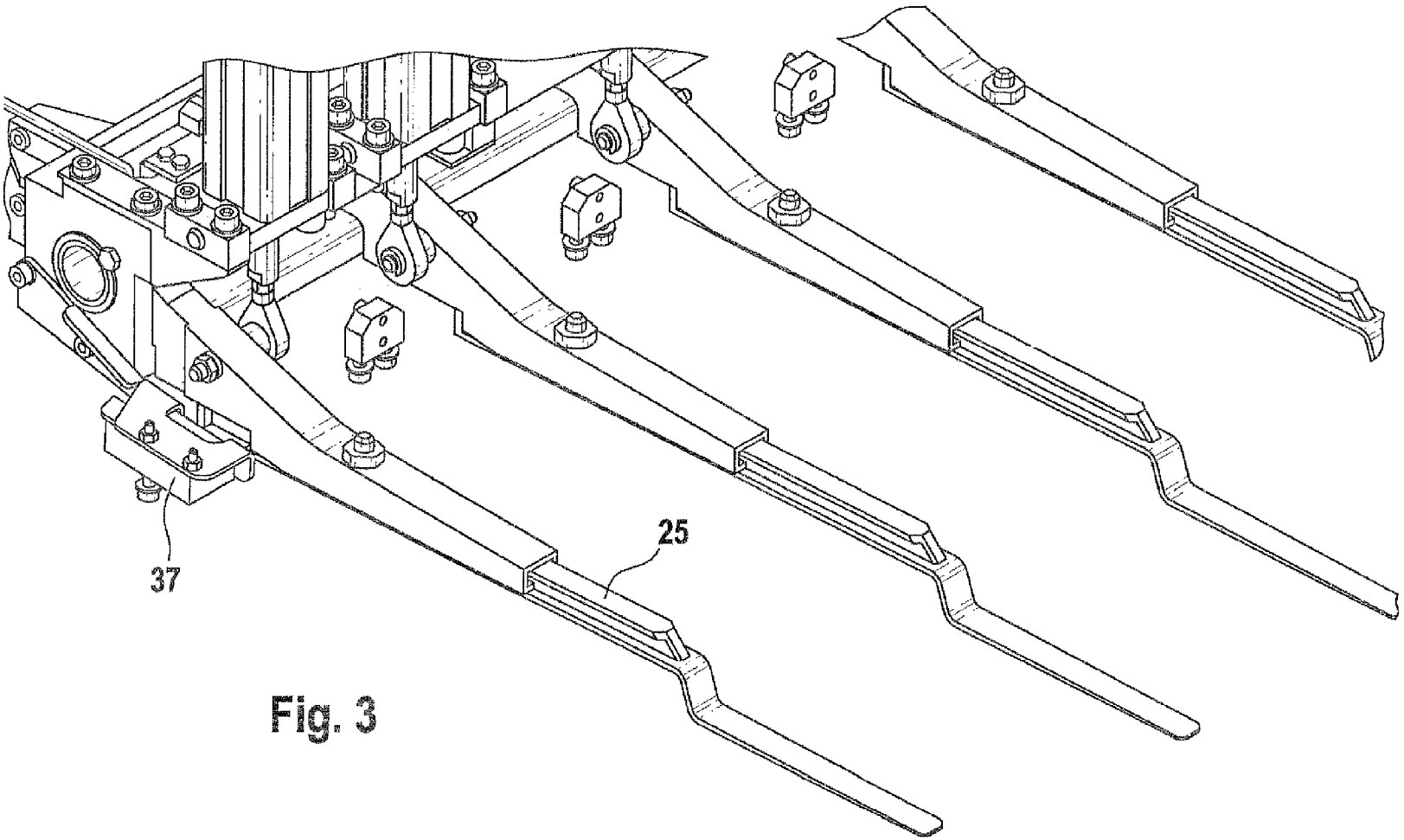
FIG. 3 shows part of the component group of FIG. 2 upon the occurrence of an overload, in perspective.

With respect to this, FIGS. 2 and 3 will now also be referred to. A holding-down unit 30 can be seen, with a total of five holding-down tongues 25. A holding-down unit 30 of this kind, in incremental operation of the device 10, serves to insert five blister stacks 2 and package inserts 3 at a time simultaneously into folding boxes 5 that are made ready. Each holding-down tongue 25 is coupled with a preferably pneumatically operated drive mechanism 31, which correspondingly controls the up and down motion of the holding-down tongues 25. It can also be seen that each of the holding-down tongues 25 is disposed in an elongated, shaftlike carrier 32. What is essential here is that the holding-down tongue 25 is disposed displaceably, by at least a certain distance, in the carrier 32, and the displacement travel is effected parallel to the insertion travel or the insertion direction of the goods to be packed (double arrow 21) into the folding box 5. Moreover, each holding-down tongue 25 is coupled wit a preferably spring-loaded, adjustable pressure element 35, which acts with a certain force on the holding-down tongue 25 and serves as an overload protector.

The carrier 32, on the side remote from the blister stack 2, has a cutout 36, into the region of which one end of the holding-down tongue 25 extends as soon as the overload protector (35) responds. The presence of the end of each holding-down tongue 25 is detected by a scanner 37 and supplied as an input signal to the control unit of the device 10. The control unit then concludes that an overload situation pertains and for instance brings about a machine stop of the device 10.

In operation of the device 10, the holding-down unit 30 together with the holding-down tongues 25 is moved in the direction of the folding boxes 5. If the overload situation occurs, the preset force of the pressure element 35 is exceeded, and the holding-down tongue 25 is displaced inside the carrier 32. This causes one end of the holding-down tongue 25 to extend into the portion 36 which is recognized by means of the scanner 37, and a corresponding signal is tripped.

The device 10 may be modified in manifold ways without departing from the concept of the invention. For instance, instead of the scanner 37, optical sensors, light gates, or the like are conceivable. The embodiment of the holding-down tongue 25 may also be modified in manifold ways. All that is essential is that if an overload occurs, only the holding-down tongue 25, with its relatively slight mass, is deflected out of its original location or path of motion, and that this is detected as an overload situation.

The foregoing relates to a preferred exemplary embodiment of the invention, it being understood that other variants and embodiments thereof are possible within the spirit and scope of the invention, the latter being defined by the appended claims.

The invention claimed is:

1. A device (10) for introducing goods to be packed (1,3) into packaging containers (5), having a first conveyor device (11) feeding the packaging containers (5) at equal spacings, having a second conveyor device (15) carrying receptacles of goods to be packed (1,3), wherein the two conveyor devices (11,15) are aligned with one another at least in an introduction region of the goods to be packed (1,3) and are operated synchronously with one another in the feeding direction of the conveyor devices (11,15), having an insertion element (20) for inserting the goods to be packed (1,3) from the receptacles into the packaging container (5), having a holding-down element (25) secured to a carrier element (32), for holding down the goods to be packed (1,3), which holding-down element (25) is displaceable transversely to the feeding direction of the conveyor devices (11,15) into the packaging container (5), having a drive mechanism (31), which, via the carrier element (32), sets the holding-down element (25) into an up and down motion, and having an overload protector (35), disposed in the carrier element (32), for the holding-down element (25), wherein overload protector (35), upon an overload on the holding-down element (25), deflects the holding-down element (25) out of its intended path of motion, and the holding-down element (25) is disposed movably on the carrier element (32), and the holding-down element (25) is guided in the carrier element (32) in the direction of the insertion motion of the goods to be packed (1,3) into the packaging container (5).

2. The device as defined by claim 1, wherein the overload protector (35) comprises an adjustable retaining element which cooperates with the holding-down element.

3. The device as defined by claim 2, wherein the retaining element is embodied as a spring-loaded pressure element.

4. The device as defined by claim 3, further comprising means for adjusting the spring force of the pressure element.

5. The device as defined by claim 3, further comprising a sensor element operable to ascertain the position of the holding-down element in the carrier element in the event that an overload occurs.

6. The device as defined by claim 2, further comprising a sensor element operable to ascertain the position of the holding-down element in the carrier element in the event that an overload occurs.

7. The device as defined by claim 2, further comprising a plurality of holding-down elements and carrier elements combined into a component group, which is movable as a unit.

8. The device as defined by claim 1, further comprising a sensor element operable to ascertain the position of the holding-down element in the carrier element in the event that an overload occurs.

9. The device as defined by claim 1, further comprising a plurality of holding-down elements and cater elements combined into a component group, which is movable as a unit.

* * * * *